US009124002B2

(12) United States Patent
Wong et al.

(10) Patent No.: US 9,124,002 B2
(45) Date of Patent: Sep. 1, 2015

(54) COMMUNICATION DEVICE

(71) Applicant: Acer Incorporated, New Taipei (TW)

(72) Inventors: Kin-Lu Wong, Kaohsiung (TW); Tseng-Wei Weng, Kaohsiung (TW)

(73) Assignee: Acer Incorporated, New Taipei (TW)

( * ) Notice: Subject to any disclaimer, the term of this patent is extended or adjusted under 35 U.S.C. 154(b) by 134 days.

(21) Appl. No.: 13/743,322

(22) Filed: Jan. 16, 2013

(65) Prior Publication Data

US 2014/0139392 A1 May 22, 2014

(30) Foreign Application Priority Data

Nov. 16, 2012 (TW) ..... 101142877 A

(51) Int. Cl.

| | |
|---|---|
| ***H01Q 1/24*** | (2006.01) |
| ***H01Q 1/52*** | (2006.01) |
| *H01Q 1/22* | (2006.01) |
| *H01Q 1/38* | (2006.01) |

(52) U.S. Cl.

CPC ..... *H01Q 1/523* (2013.01); *H01Q 1/521* (2013.01); *H01Q 1/2266* (2013.01); *H01Q 1/2291* (2013.01); *H01Q 1/38* (2013.01)

(58) Field of Classification Search

CPC ..... H01Q 1/521; H01Q 1/243; H01Q 1/2266
USPC ..... 343/841, 702, 893
See application file for complete search history.

(56) References Cited

U.S. PATENT DOCUMENTS

| | | | | |
|---|---|---|---|---|
| 7,330,156 | B2 | 2/2008 | Arkko et al. | |
| 7,965,242 | B2 * | 6/2011 | Abramov et al. | 343/702 |
| 2005/0184921 | A1 | 8/2005 | Roberts et al. | |
| 2006/0044195 | A1 | 3/2006 | Arkko et al. | |
| 2008/0169986 | A1 * | 7/2008 | Cheng et al. | 343/702 |
| 2011/0140973 | A1 * | 6/2011 | Yamagajo et al. | 343/702 |
| 2012/0169550 | A1 | 7/2012 | Schlub et al. | |
| 2013/0293425 | A1 * | 11/2013 | Zhu et al. | 343/702 |

FOREIGN PATENT DOCUMENTS

| | | |
|---|---|---|
| CN | 201430211 | 3/2010 |
| CN | 102738570 | 10/2012 |
| CN | 102760949 | 10/2012 |
| JP | 2008245132 | 10/2008 |
| TW | M370846 | 12/2009 |
| WO | 2011101851 | 8/2011 |
| WO | 2013028317 | 2/2013 |

* cited by examiner

*Primary Examiner* — Dieu H Duong
(74) *Attorney, Agent, or Firm* — Jianq Chyun IP Office

(57) ABSTRACT

A communication device including a first antenna, a second antenna, a ground element, and an isolation element is provided. The ground element is coupled to a conductive plane. The isolation element is disposed between the first antenna and the second antenna and includes a first portion and a second portion. A first end of the first portion and a first end of the second portion are respectively coupled to the ground element, and a second end of the first portion is spaced apart a coupling distance from a second end of the second portion.

12 Claims, 5 Drawing Sheets

COMMUNICATION DEVICE

CROSS-REFERENCE TO RELATED APPLICATION

This application claims the priority benefit of Taiwan application serial no. 101142877, filed on Nov. 16, 2012. The entirety of the above-mentioned patent application is hereby incorporated by reference herein and made a part of this specification.

BACKGROUND OF THE INVENTION

1. Field of the Invention

The invention generally relates to a communication device, and more particularly, to a communication device with an antenna system having high isolation and high radiation efficiency.

2. Description of Related Art

Along with the widespread of wireless network applications and fast development of technologies, the transmission capacity and transmission rate of communication devices have been constantly increased. Thus, multi-input multi-output (MIMO) systems with multiple antennas and the ability to simultaneously transmit and receive signals have been attracting more and more attention. In other words, multi-antenna operation has become one of the future development trends. In addition, owing to the limited internal spaces of communication devices, the antennas are spaced close to each other and isolation elements are usually disposed therebetween to improve the isolation between the antennas. Generally, a conventional isolation element has an open end and captures a coupling current from a ground plane between two antennas. However, the conventional isolation element may turn into a parasitic radiation element, which may cause the radiation efficiency of the antennas to decrease.

Thereby, how to maintain the original radiation efficiency of an antenna when the isolation between the antennas in the antenna system is improved has become a major subject for a communication device with an antenna system.

SUMMARY OF THE INVENTION

Accordingly, the invention is directed to a communication device, in which the isolation between antennas is improved by disposing an isolation element between the antennas, and at the same time, the original radiation efficiency of the antennas is maintained.

The invention provides a communication device including a first antenna, a second antenna, a ground element, and an isolation element. The ground element is coupled to a conductive plane. The isolation element is disposed between the first antenna and the second antenna and includes a first portion and a second portion. A first end of the first portion and a first end of the second portion are respectively coupled to the ground element, and a second end of the first portion is spaced apart a coupling distance from a second end of the second portion.

As described above, in the invention, the isolation between a first antenna and a second antenna is improved by disposing an isolation element between the first antenna and the second antenna. A first portion and a second portion of the isolation element are respectively equivalent to a resonator when the first portion and the second portion are respectively in a condition of resonance. Thus, at the same time when the isolation element is disposed to improve the isolation between the first antenna and the second antenna, the original radiation efficiency of the first antenna and the second antenna is maintained.

These and other exemplary embodiments, features, aspects, and advantages of the invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
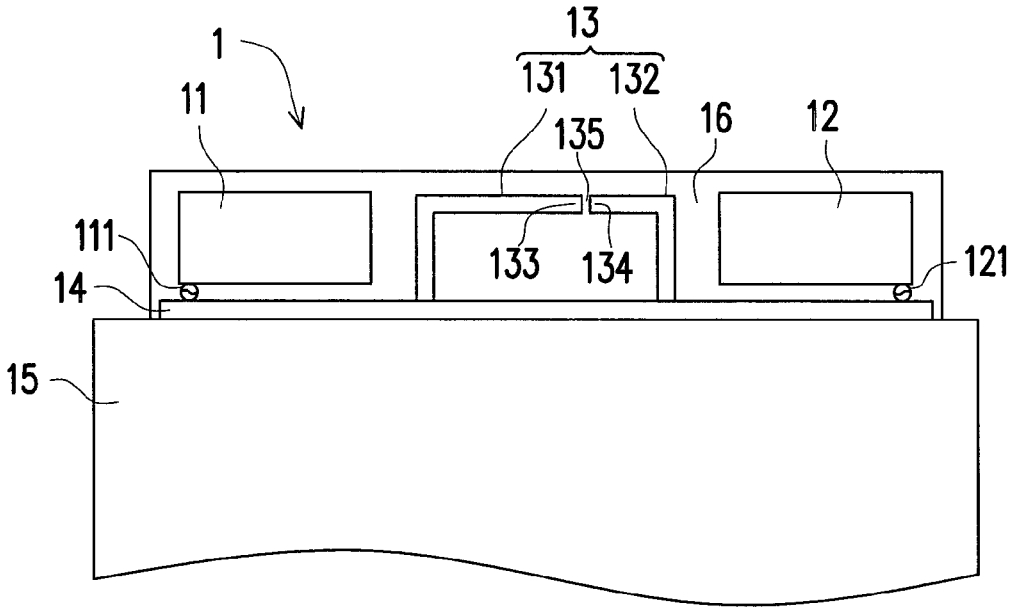
FIG. 1 is a structure diagram of a communication device according to a first embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a structure diagram of a communication device according to a first embodiment of the invention. Referring to FIG. 1, in the present embodiment, the communication device 1 includes a first antenna 11, a second antenna 12, an isolation element 13, and a ground element 14. The first antenna 11, the second antenna 12, the isolation element 13, and the ground element 14 form an antenna system, and the antenna system is adjacent to a conductive plane 15. The communication device 1 may be a notebook computer or a tablet computer, and the conductive plane 15 may be disposed on a supporting backplate of a top cover of the notebook computer or on a supporting backplate of the tablet computer.

The antenna system is disposed on a dielectric substrate 16 to form a planar structure. The isolation element 13 in the antenna system is disposed between the first antenna 11 and the second antenna 12. Namely, the first antenna 11, the isolation element 13, and the second antenna 12 are sequentially arranged along an edge of the ground element 14. The ground element 14 is coupled to the conductive plane 15. The communication device 1 transmits a signal source 111 to the first antenna 11 so as to excite the first antenna 11. The communication device 1 also transmits another signal source 121 to the second antenna 12 so as to excite the second antenna 12. The first antenna 11 and the second antenna 12 have at least one same communication band, the antenna system is operated in at least a first communication band and a second communication band, and the frequency of the first communication band is lower than the frequency of the second communication band.

The isolation element 13 includes a first portion 131 and a second portion 132. The first antenna 11, the first portion 131 of the isolation element 13, the second portion 132 of the isolation element 13, and the second antenna 12 are sequentially arranged along an edge of the ground element 14. The first portion 131 has an inverted L shape, and the second portion 132 also has an inverted L shape. A first end of the first portion 131 is coupled to the ground element 14, and the first portion 131 resonates in the first communication band. A first end of the second portion 132 is also coupled to the ground element 14, and the second portion 132 resonates in the second communication band. A second end 133 of the first portion 131 and a second end 134 of the second portion 132 are both open ends. Additionally, the second end 133 of the first portion 131 is spaced apart a coupling distance 135 from the second end 134 of the second portion 132. Be noted that, in this embodiment, the second end 133 of the first portion 131 and the second end 134 of the second portion 132 are spaced to the ground element with the same distance.

It should be noted that the first portion 131 and the second portion 132 of the isolation element 13 can capture a coupling current between the first antenna 11 and the second antenna 12. Besides, by coupling effect between the second end 133 and the second end 134, the first portion 131 and the second portion 132 can be regarded as extensions of the ground element 14. Moreover, the first portion 131 and the second portion 132 are respectively equivalent to a resonator rather than a radiator when they are respectively at resonance. Thus, when the isolation between the first antenna 11 and the second antenna 12 is improved by disposing the isolation element 13, the original radiation efficiency of the first antenna 11 and the second antenna 12 is maintained.

Figure 2A:
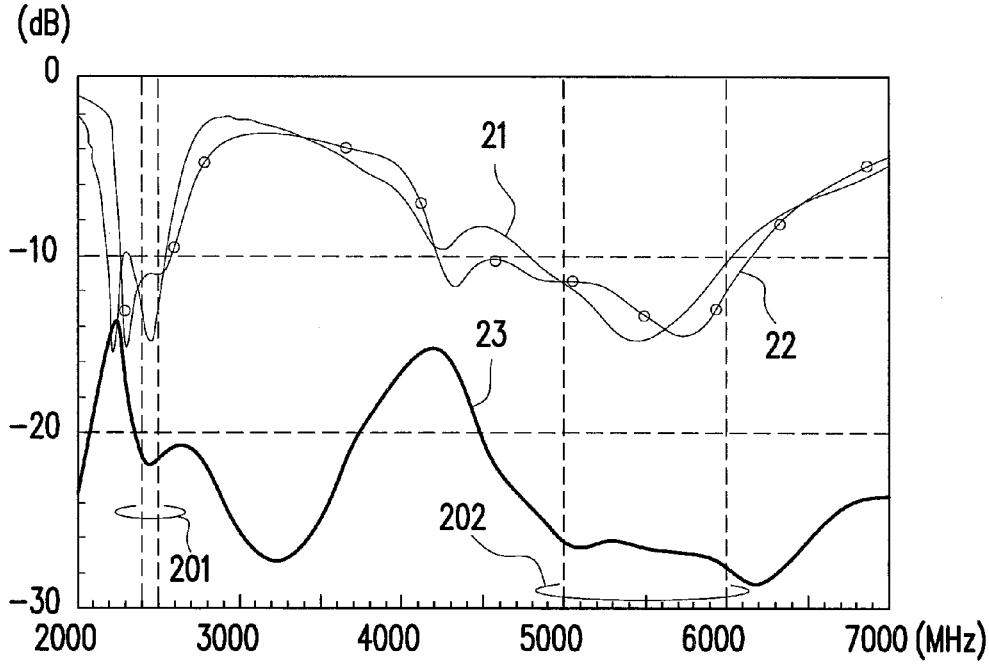
FIG. 2A is an S-parameter graph of a communication device provided by the invention.

FIG. 2A is an S-parameter graph of a communication device provided by the invention. The overall dimensions of the antenna system illustrated in FIG. 1 are about 60×9 $mm^2$, the curve 21 represents a reflection coefficient $S_{11}$ of the first antenna 11, and the curve 22 represents a reflection coefficient $S_{22}$ of the second antenna 12. As indicated by the curves 21 and 22, with the reflection coefficient defined to be −10 dB, the communication device 1 is operated in the first communication band 201 and the second communication band 202. Herein the operating bandwidth of the first communication band 201 covers the 2.4 GHz band (2400-2484 MHz) of WLAN, and the operating bandwidth of the second communication band 202 covers the 5.2/5.8 GHz band (5150-5350/5725-5875 MHz) of WLAN. Besides, the curve 23 represents the isolation $S_{21}$ between the first antenna 11 and the second antenna 12. As indicated by the curve 23, in the first communication band 201 and the second communication band 202, the isolation $S_{21}$ between the first antenna 11 and the second antenna 12 is respectively below −21 dB and below −26 dB.

Figure 2B:
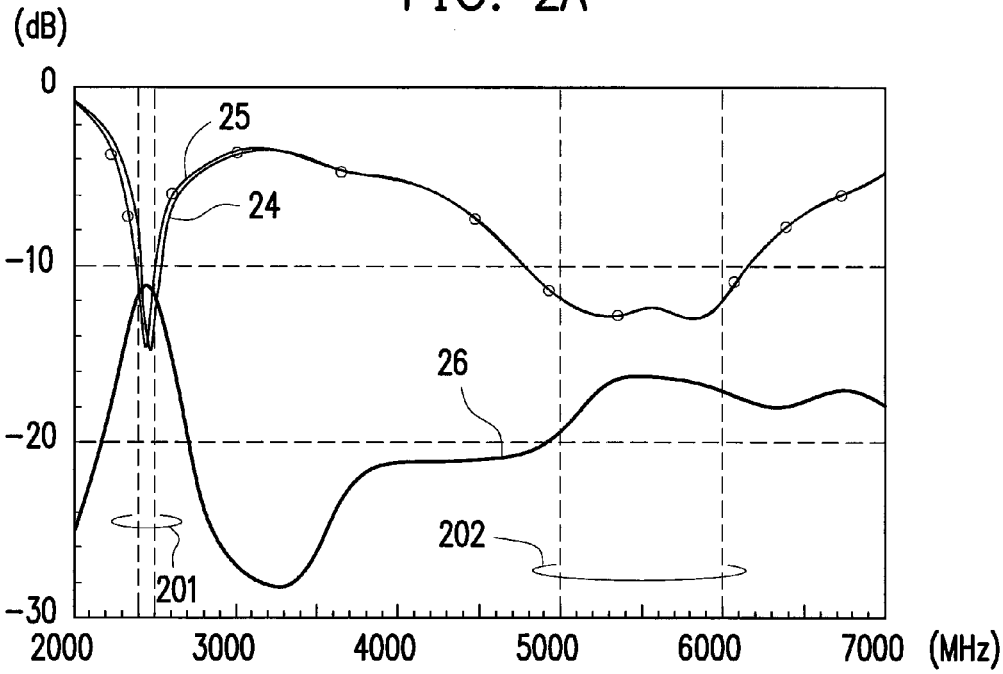
FIG. 2B is an S-parameter graph of a communication device provided by the invention when no isolation element is disposed.

FIG. 2B is an S-parameter graph of a communication device provided by the invention when no isolation element is disposed. In FIG. 2B, curves 24-26 respectively represent the reflection coefficient $S_{11}$ of the first antenna 11, the reflection coefficient $S_{22}$ of the second antenna 12, and the isolation $S_{21}$ between the first antenna 11 and the second antenna 12 when no isolation element 13 is disposed. As shown in FIG. 2B, with the reflection coefficient defined to be −10 dB, the communication device 1 is also operated in the first communication band 201 and the second communication band 202. However, since the isolation element 13 is not disposed, the isolation $S_{21}$ between the first antenna 11 and the second antenna 12 can only reach about −11 dB and −16 dB respectively in the first communication band 201 and the second communication band 202. In other words, it can be understood by referring to both FIG. 2A and FIG. 2B that, in the first communication band 201 and the second communication band 202, the disposition of the isolation element 13 can increase the isolation between the first antenna 11 and the second antenna 12 by about 10 dB.

Figure 3:
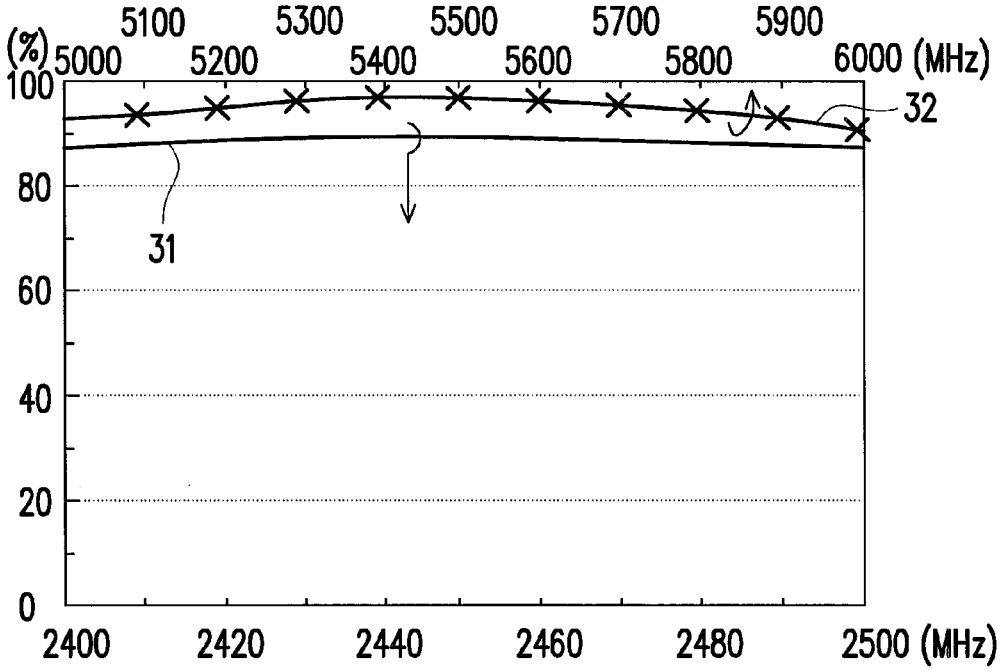
FIG. 3 is a graph of radiation efficiencies of an antenna in a communication device provided by the invention.

FIG. 3 is a graph of radiation efficiencies (including the mismatching loss) of an antenna in a communication device provided by the invention. Referring to FIG. 3, the curves 31 and 32 respectively represent the radiation efficiency of the first antenna 11 in the first communication band 201 and the second communication band 202. As indicated by the curves 31 and 32, the radiation efficiency of the first antenna 11 in the first communication band 201 is at least 87%, and the radiation efficiency thereof in the second communication band 202 is at least 93%. In the present embodiment, the first portion 131 and the second portion 132 of the isolation element 13 are respectively equivalent to a resonator rather than a radiator when they are respectively at resonance. Thus, the first antenna 11 and the second antenna 12 retain their original high radiation efficiencies.

Figure 4:
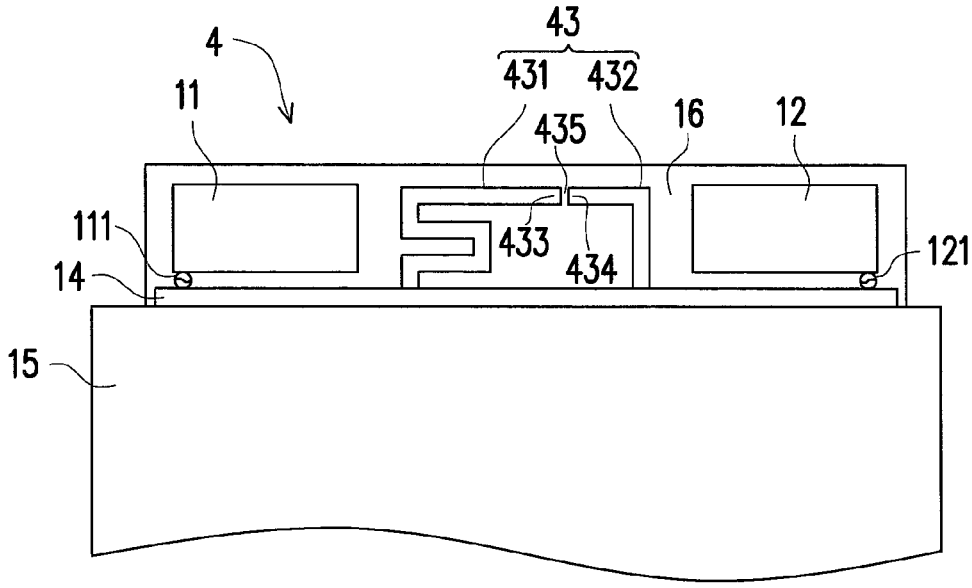
FIG. 4 is a structure diagram of a communication device according to a second embodiment of the invention.

FIG. 4 is a structure diagram of a communication device according to a second embodiment of the invention. The communication device 4 in the second embodiment has a structure similar to that of the communication device 1 in the first embodiment. The major difference between the two embodiments is that in the second embodiment, the isolation element 43 also has a first portion 431 and a second portion 432, while a part of the first portion 431 has a meandering structure. Accordingly, the height of the isolation element 43 and the overall size of the antenna system can be reduced. In addition, similar to that in the first embodiment, a first end of the first portion 431 and a first end of the second portion 432 are respectively coupled to the ground element 14. Moreover, a second end 433 of the first portion 431 and a second end 434 of the second portion 432 are both open ends and are at a coupling distance 435 apart from each other. With this similar structure, the antenna system in the second embodiment can achieve the same functions as the antenna system in the first embodiment.

Figure 5:
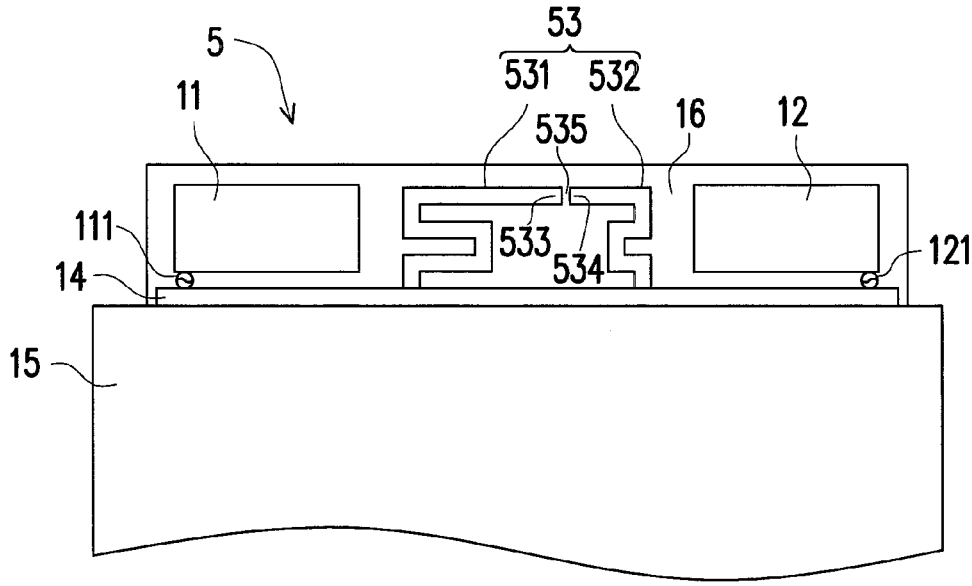
FIG. 5 is a structure diagram of a communication device according to a third embodiment of the invention.

FIG. 5 is a structure diagram of a communication device according to a third embodiment of the invention. The communication device 5 in the third embodiment has a structure similar to that of the communication device 1 in the first embodiment. The major difference between the two embodiments is that in the third embodiment, the isolation element 53 also has a first portion 531 and a second portion 532, while a part of the first portion 531 and a part of the second portion 532 respectively have a meandering structure. Accordingly, the height of the isolation element 53 or the overall size of the antenna system can be reduced. In addition, similar to that in the first embodiment, a first end of the first portion 531 and a first end of the second portion 532 are respectively coupled to the ground element 14. Moreover, a second end 533 of the first portion 531 and a second end 534 of the second portion 532 are both open ends and are at a coupling distance 535 apart from each other. With this similar structure, the antenna system in the third embodiment can achieve the same functions as the antenna system in the first embodiment.

Figure 6:
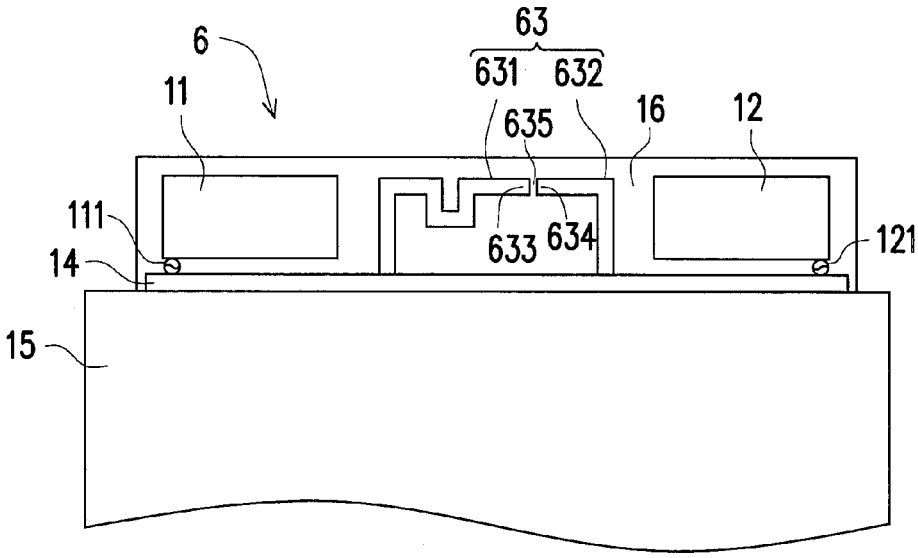
FIG. 6 is a structure diagram of a communication device according to a fourth embodiment of the invention.

FIG. 6 is a structure diagram of a communication device according to a fourth embodiment of the invention. The communication device 6 in the fourth embodiment has a structure similar to that of the communication device 1 in the first embodiment. The major difference between the two embodiments is that in the fourth embodiment, the isolation element 63 also has a first portion 631 and a second portion 632, while a part of the first portion 631 has a meandering structure. Accordingly, the width of the isolation element 63 or the overall size of the antenna system can be reduced. In addition, similar to that in the first embodiment, a first end of the first portion 631 and a first end of the second portion 632 are respectively coupled to the ground element 14. Moreover, a second end 633 of the first portion 631 and a second end 634 of the second portion 632 are both open ends and are at a coupling distance 635 apart from each other. With this similar structure, the antenna system in the fourth embodiment can achieve the same functions as the antenna system in the first embodiment.

Figure 7:
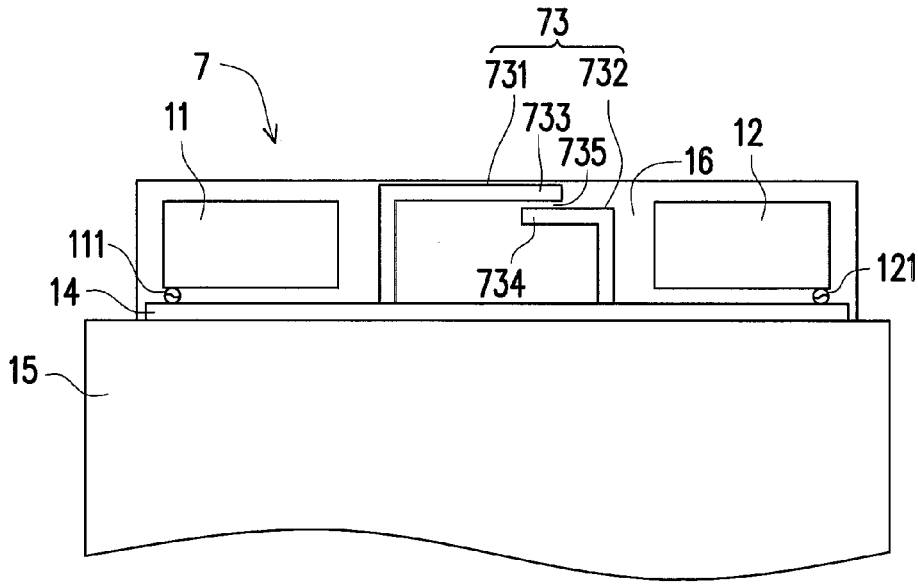
FIG. 7 is a structure diagram of a communication device according to a fifth embodiment of the invention.

FIG. 7 is a structure diagram of a communication device according to a fifth embodiment of the invention. The communication device 7 in the fifth embodiment has a structure similar to that of the communication device 1 in the first embodiment. The major difference between the two embodiments is that in the fifth embodiment, the isolation element 73 also has a first portion 731 and a second portion 732, while a second end 733 of the first portion 731 and a second end 734 of the second portion 732 are not spaced to the ground element with same distances. In addition, similar to that in the first embodiment, a first end of the first portion 731 and a first end of the second portion 732 are respectively coupled to the ground element 14. Moreover, the second end 733 of the first portion 731 and the second end 734 of the second portion 732 are both open ends and are at a coupling distance 735 apart from each other. Furthermore, the width of the isolation element 73 is smaller than that of the isolation element 13 in the first embodiment. With this similar structure, the antenna system in the fifth embodiment can achieve the same functions as the antenna system in the first embodiment.

As described above, in the invention, the isolation between antennas is improved by disposing an isolation element between the antennas. A first portion and a second portion of the isolation element can capture a coupling current between the antennas. In addition, the first portion and the second portion of the isolation element are respectively equivalent to a resonator when they respectively resonate. Thereby, at the same time when the isolation element is disposed to improve the isolation between the antennas, the original radiation efficiency of the antennas is maintained.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A communication device, comprising:

a first antenna;

a second antenna;

a ground element, coupled to a conductive plane; and an isolation element, disposed between the first antenna and the second antenna, and comprising a first portion and a second portion, wherein a first end of the first portion and a first end of the second portion are respectively coupled to the ground element, the first portion faces to the first antenna, the second portion faces to the second antenna, and a second end of the first portion is spaced apart a coupling distance from a second end of the second portion, wherein the communication device is operated in at least a first communication band and a second communication band, a frequency of the first communication band is lower than a frequency of the second communication band, and the first portion and the second portion of the isolation element resonate respectively in the first communication band and the second communication band so as to improve isolation between the first antenna and the second antenna in the first communication band and the second communication band.

2. The communication device according to claim 1, wherein the second end of the first portion is an open end, and the second end of the second portion is an open end.

3. The communication device according to claim 1, wherein the first antenna, the first portion of the isolation element, the second portion of the isolation element, and the second antenna are sequentially arranged along an edge of the ground element.

4. The communication device according to claim 1, wherein the first antenna and the second antenna are operated in at least one same communication band.

5. The communication device according to claim 1, wherein the first antenna, the second antenna, the isolation element, and the ground element form an antenna system, and the antenna system is adjacent to the conductive plane and disposed on a dielectric substrate to form a planar structure.

6. The communication device according to claim 1, wherein the second end of the first portion and the second end of the second portion of the isolation element are spaced to the ground element with different distances.

7. The communication device according to claim 1, wherein the second end of the first portion and the second end of the second portion of the isolation element are spaced to the ground element with the same distance.

8. The communication device according to claim 1, wherein a shape of the first portion is an inverted L shape.

9. The communication device according to claim 1, wherein a shape of the second portion is an inverted L shape.

10. The communication device according to claim 1, wherein the communication device is a notebook computer or a tablet computer, and the conductive plane is disposed on a supporting backplate of a top cover of the notebook computer or on a supporting backplate of the tablet computer.

11. The communication device according to claim 1, wherein a part of the first portion comprises a meandering structure.

12. The communication device according to claim 1, wherein a part of the second portion comprises a meandering structure.

* * * * *